US009797223B1

(12) United States Patent
Gordon

(10) Patent No.: US 9,797,223 B1
(45) Date of Patent: Oct. 24, 2017

(54) SYSTEMS AND METHODS FOR HYDRATE REMOVAL

(71) Applicant: ONESUBSEA IP UK LIMITED, London (GB)

(72) Inventor: Alexandre James Gordon, Aberdeen (GB)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 15/238,821

(22) Filed: Aug. 17, 2016

(51) Int. Cl.

| | |
|---|---|
| ***E21B 33/076*** | (2006.01) |
| ***E21B 41/00*** | (2006.01) |
| ***E21B 17/01*** | (2006.01) |
| ***E21B 33/035*** | (2006.01) |

(52) U.S. Cl.
CPC ..... *E21B 41/0007* (2013.01); *E21B 17/01* (2013.01); *E21B 33/035* (2013.01)

(58) Field of Classification Search
CPC ..... E21B 17/01; E21B 33/035; E21B 33/076; E21B 37/00; E21B 41/0007; E21B 41/02
See application file for complete search history.

(56) References Cited

U.S. PATENT DOCUMENTS

| | | | | |
|---|---|---|---|---|
| 8,220,552 | B2 * | 7/2012 | Kinnari | F17D 1/05 166/344 |
| 8,430,169 | B2 * | 4/2013 | Stoisits | E21B 37/06 137/7 |
| 2004/0154794 | A1 * | 8/2004 | Appleford | E21B 43/34 166/267 |
| 2010/0047022 | A1 * | 2/2010 | Le Moign | E02F 3/907 405/184.1 |
| 2011/0158824 | A1 * | 6/2011 | Wright | B01D 19/0042 417/53 |
| 2011/0232912 | A1 * | 9/2011 | Close | E21B 43/01 166/335 |
| 2015/0136409 | A1 * | 5/2015 | Hall | E21B 17/20 166/344 |

FOREIGN PATENT DOCUMENTS

| | | | | |
|---|---|---|---|---|
| BR | WO 2011057369 | A1 * | 5/2011 | E21B 43/013 |
| BR | WO 2012149620 | A1 * | 11/2012 | B05C 7/08 |

* cited by examiner

*Primary Examiner* — Matthew R Buck
(74) *Attorney, Agent, or Firm* — Conley Rose, P.C.

(57) ABSTRACT

A method for treating the formation of hydrates in a fluid system includes pumping a fluid at a substantially constant fluid flow rate through a hydrate removal system including a pressure modulator, communicating a vacuum pressure to a piece of subsea equipment from a pressure port of the pressure modulator, closing a valve in the hydrate removal system to cease the fluid flow through the hydrate removal system at the substantially constant fluid flow rate, and communicating a positive pressure greater than the vacuum pressure to the piece of subsea equipment in response to closing the valve of the hydrate removal system.

20 Claims, 5 Drawing Sheets

SYSTEMS AND METHODS FOR HYDRATE REMOVAL

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Natural-gas hydrates comprise crystalline solids that form when water and hydrocarbons combine at particular temperatures and pressures above the normal freezing conditions for water. The formation of hydrates may occur in oil and natural gas wells, subsea equipment, pipelines, pumping systems, production systems, and other industrial applications. Once formed, hydrate plugs may be removed through altering the environmental conditions within the plugged equipment, such as by reducing fluid pressure, adding or increasing the concentration of hydrate inhibitors, and/or increasing the fluid temperature, each of which adds to the cost and complexity of the fluid system. Moreover, conventional hydrate remediation techniques sometimes include depressurizing entire flow lines instead of affected sections thereof in order to prevent accelerating loosened hydrate plugs which may damage components of the fluid system.

SUMMARY

An embodiment of a fluid system comprises an injection conduit extending between a pump and an inlet of a pressure modulator, a return conduit extending between the pump and an outlet of the pressure modulator, and a pressure conduit extending from a pressure port of the pressure modulator, and wherein the pressure conduit is in selective fluid communication with a piece of subsea equipment, wherein the pump is configured to provide a continuous fluid flow through the injection conduit, pressure modulator, and return conduit, wherein the pressure modulator comprises a reduced diameter section disposed between the inlet and the outlet, and wherein the pressure port is in fluid communication with the reduced diameter section, wherein, in response to the provision of continuous fluid flow through the pressure modulator by the pump, a vacuum pressure is communicated to the piece of subsea equipment from the reduced diameter section of the pressure modulator to remove a hydrate blockage formed in the piece of subsea equipment. In some embodiments, the pump is disposed on a surface vessel and the injection conduit and return conduit each extend from the surface vessel towards a sea floor. In some embodiments, the fluid system further comprises a hydrate skid disposed subsea and spaced from the piece of subsea equipment, wherein the pressure conduit is connected to the hydrate skid, and a jumper conduit extending between the hydrate skid and the piece of subsea equipment, wherein the hydrate skid comprises a hydrate skid valve configured to provide selective fluid communication between the pressure conduit and the jumper conduit. In certain embodiments, the pump, the injection conduit, and the return conduit form a continuous fluid loop. In certain embodiments, the fluid loop comprises a hydrate removal valve configured to selectively prohibit continuous fluid flow through the fluid loop. In some embodiments, in response to closure of the hydrate removal valve, the pump is configured to communicate a positive pressure greater than the vacuum pressure to the piece of subsea equipment. In some embodiments, the positive pressure comprises the maximum design pressure of the piece of subsea equipment.

An embodiment of a fluid system comprises an injection conduit extending between a pump and an inlet of a pressure modulator, a hydrate skid comprising a piston slidably disposed within a cylinder, and wherein an outer surface of the piston sealingly engages an inner surface of the cylinder to form a first chamber extending between a first end of the cylinder and the piston and a second chamber extending between a second end of the cylinder and the piston, a pressure conduit extending from a pressure port of the pressure modulator and in selective fluid communication with the second chamber of the cylinder, and a jumper conduit in selective fluid communication with the first chamber of the cylinder and a piece of subsea equipment, wherein the pump is configured to provide a continuous fluid flow through the injection conduit and pressure modulator, wherein, in response to the provision of continuous fluid flow through the pressure modulator by the pump, a vacuum pressure is communicated to the piece of subsea equipment from the pressure port of the pressure modulator to remove a hydrate blockage formed in the piece of subsea equipment. In some embodiments, the pump is disposed on a surface vessel and the injection conduit extends from the surface vessel towards a sea floor. In some embodiments, in response to the provision of continuous fluid flow through the pressure modulator by the pump, the vacuum pressure is communicated to the second chamber of the cylinder, and in response to communication of the vacuum pressure to the second chamber of the cylinder, the piston is configured to be displaced through the cylinder to communicate the vacuum pressure to the first chamber of the cylinder. In certain embodiments, the hydrate skid comprises a storage tank in fluid communication with the first chamber of the cylinder, and wherein the storage tank is configured to store hydrocarbons received from the piece of subsea equipment in response to the removal of the hydrate blockage. In certain embodiments, the pressure modulator comprises a reduced diameter section disposed between the inlet and an outlet, and wherein the pressure port is in fluid communication with the reduced diameter section. In some embodiments, the fluid system further comprises a vent line extending from the outlet of the pressure modulator and in fluid communication with the surrounding environment, wherein the vent line comprises a vent valve configured to provide selective fluid communication between the outlet of the pressure modulator and the surrounding environment. In some embodiments, in response to closure of the vent valve, the pump is configured to communicate a positive pressure greater than the vacuum pressure to the piece of subsea equipment.

An embodiment of a method for treating the formation of hydrates in a fluid system comprises pumping a fluid at a substantially constant fluid flow rate through a hydrate removal system comprising a pressure modulator, communicating a vacuum pressure to a piece of subsea equipment from a pressure port of the pressure modulator, closing a valve in the hydrate removal system to cease the fluid flow through the hydrate removal system at the substantially constant fluid flow rate, and communicating a positive pressure greater than the vacuum pressure to the piece of subsea equipment in response to closing the valve of the hydrate removal system. In some embodiments, the method further comprises displacing a piston in a first direction through a cylinder in response to pumping fluid at the substantially constant fluid flow rate to communicate the vacuum pressure between a pair of chambers formed in the cylinder. In some embodiments, the method further comprises isolating the piston and communicating the positive pressure to the piece of subsea equipment through a conduit bypassing the piston. In certain embodiments, the method further comprises pumping the fluid at the substantially constant flow rate from a pump through an injection conduit, through the pressure modulator, and from the pressure modulator to the pump via a return conduit. In certain embodiments, the method further comprises venting the fluid to the surrounding environment via a vent line extending from an outlet of the pressure modulator. In some embodiments, the method further comprises increasing the fluid flow rate of the fluid in response to flowing the fluid through a reduced diameter section of the pressure modulator to form a vacuum pressure in the reduced diameter section.

BRIEF DESCRIPTION OF THE DRAWINGS

The subject disclosure is further described in the following detailed description, and the accompanying drawings and schematics of non-limiting embodiments of the subject disclosure. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
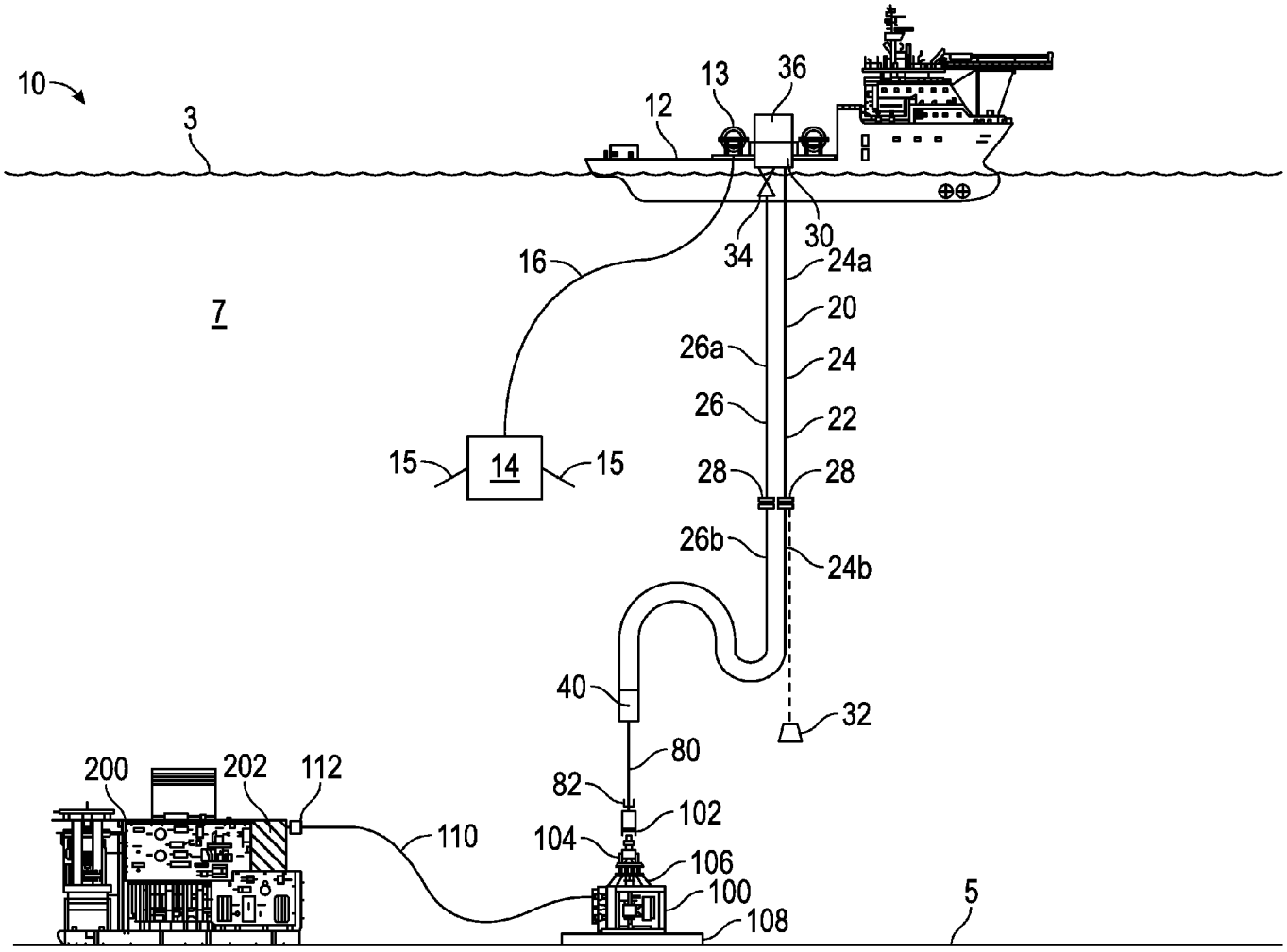
FIG. 1 is a schematic view of an embodiment of a fluid system in accordance with principles disclosed herein.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Referring to FIG. 1, an embodiment of a fluid system 10 is shown schematically. Although in FIG. 1 fluid system 10 is shown as comprising a subsea or offshore fluid system, in other embodiments, components of fluid system 10 may comprise an onshore fluid or production system. In the embodiment shown in FIG. 1, fluid system 10 generally includes a surface vessel 12, a hydrate removal system 20, a hydrate skid assembly 100, and a piece of subsea equipment 200. Surface vessel 12 is disposed at the water line 3 while both hydrate skid 100 and subsea equipment 200 are positioned at or proximal the sea floor 5. Hydrate removal system 20 is coupled to both surface vessel 12 and hydrate skid 100 and extends from the water line 3 towards the sea floor 5 through the sea 7. Although surface vessel 12 is shown in FIG. 1 as comprising a ship, in other embodiments, surface vessel 12 may comprise an offshore platform or other structure disposed proximal the water line 3. In the embodiment shown in FIG. 1, surface vessel 12 comprises a deployment system 13 for extending and retracting hydrate removal system 20 from and to surface vessel 12. In some embodiments, deployment system 13 may comprise a tubing reel and an injector head. Additionally, a remotely operated vehicle (ROV) 14 is coupled to surface vessel 12 via an umbilical 16 for providing electrical, hydraulic, or other resources to ROV 14. ROV 14 includes a pair of actuatable arms 15 for actuating or manipulating components of fluid system 10, including components of hydrate skid 100 and subsea equipment 200.

In the embodiment shown in FIG. 1, hydrate removal system 20 generally includes a fluid or hydrate removal flow loop 22, a pressure modulator 40, and a pressure conduit 80. Flow loop 22 is generally configured to provide continuous fluid flow through pressure modulator 40 of hydrate removal system 20. In this embodiment, flow loop 22 generally includes an injection fluid conduit 24, a return fluid conduit 26, and a pump or compressor 30. Pump 30 is disposed on the surface vessel 12 and is configured to selectively produce a fluid flow through the injection conduit 24 and return conduit 26. Although in this embodiment pump 30 is disposed on vessel 12, in other embodiments, pump 30 may be located subsea either suspended from vessel 12 or disposed at or proximal the sea floor 5.

In this embodiment, both the injection conduit 24 and return conduit 26 comprise corresponding upper rigid conduits or risers 24*a* and 26*a*, respectively, and lower flexible or compliant conduits or risers 24*b* and 26*b*, respectively. Rigid conduits 24*a* and 26*a* each extend from surface vessel 12 and mate with corresponding flexible conduits 24*a* and 26*a*, respectively, via one or more conduit interfaces or connections 28. Rigid conduits 24*a* and 26*a* are placed under tension via a subsea weight 32 suspended from conduit interface 28. Flexible conduits 24*b* and 26*b* extend from conduit interface 28 to the pressure modulator 40 and allow for the establishment of fluid communication between hydrate removal system 20 and hydrate skid 100 without longitudinally aligning rigid conduits 24*a* and 26*a* with hydrate skid 100. Although in this embodiment conduits 24*a* and 26*a* comprise rigid conduits, in other embodiments, conduits 24*a* and 26*a* may comprise flexible conduits.

Additionally, in this embodiment the rigid conduit 26*b* of return conduit 26 includes a fluid loop valve 34 located at the surface vessel 12 and configured to selectively permit fluid flow through rigid conduit 26*a* Although in the embodiment shown in FIG. 1 fluid loop valve 34 is coupled with rigid conduit 26*a* at surface vessel 12, in other embodiments, fluid loop valve 34 may be located subsea and may be connected with injection conduit 24. For instance, in certain embodiments fluid loop valve 34 may be located subsea and may comprise an ROV actuatable valve such that ROV 14 may be used to actuate fluid loop valve 34 between open and closed positions. In the embodiment shown in FIG. 1, fluid system 10 further includes a storage tank 36 disposed on the surface vessel 12. Tank 36 is in fluid communication with hydrate removal system 20 and is configured to store hydrocarbons received from subsea equipment 200 following the removal of a hydrate blockage, as will be discussed further herein. Pressure conduit 80 provides a fluid connection or communication between pressure modulator 40 and hydrate skid 100 via a first or hydrate fluid connection 82. In this embodiment, hydrate connection 82 comprises an ROV operable connection configured to be connected and disconnected in-situ subsea by ROV 14; however, in other embodiments, hydrate connection 82 may comprise a remotely operated valve actuated in response to the communication of a signal from a controller or control system.

Hydrate skid 100 of fluid system 10 is generally configured to provide an interface between hydrate removal system 20 and subsea equipment 200. Although in the embodiment shown in FIG. 1 fluid system 10 includes hydrate skid 100, in other embodiments, hydrate removal system 20 may be directly connected with subsea equipment 200 without the interface provided by hydrate skid 100. In the embodiment shown in FIG. 1, hydrate skid 100 generally includes a swivel 102, a pressure balanced weak-link coupling (PBWL) 104, a flex joint 106, and a mud mat 108 for physically supporting hydrate skid 100 on the sea floor 5. Swivel 102 and flex joint 106 of hydrate skid 100 provide for relative movement between hydrate skid 100 and pressure conduit 80. PBWL 104 provides a safety 'weak link' or failure point configured to separate in the event of an impact or other accidental load applied to components of fluid system 10. A fluid connection or communication is provided between hydrate skid 100 and subsea equipment 300 via a flexible jumper or conduit 110 extending therebetween, where jumper 110 is releasably connectable to subsea equipment 200 via a second or subsea equipment connection 112. In this embodiment, equipment connection 112 comprises an ROV operable connection configured to be connected and disconnected in-situ subsea by ROV 14; however, in other embodiments, equipment connection 112 may comprise a remotely operated valve actuated in response to the communication of a signal from a controller or control system.

In the embodiment shown in FIG. 1, subsea equipment 200 comprises a subsea Christmas tree or tree 200 configured to control the production or flow of hydrocarbons from a subsea well to a hydrocarbon storage system and/or a subsea production pipeline. Although in the embodiment shown in FIG. 1 subsea equipment 200 comprises a subsea tree, in other embodiments, subsea equipment may comprise other subsea equipment providing for transport, routing, or storage of hydrocarbons. For example, in certain embodiments subsea equipment 200 may comprise subsea pipelines, templates, manifolds, production or injection wells, and other equipment. In this embodiment, subsea tree 200 comprises an injection insert assembly 202 releasably connectable with both the subsea tree 200, and jumper 110 via equipment connection 112. Injection insert 202 is generally configured to provide access to production fluid flow from subsea tree 200. In some embodiments, injection insert 202 comprises a production choke insert assembly. In certain embodiments, injection insert 202 comprises the Multiple Application Reinjection System (MARS™) provided by OneSubsea® located at 4646 West Sam Houston Pkwy N, Houston, Tex. 77041.

Figure 2:
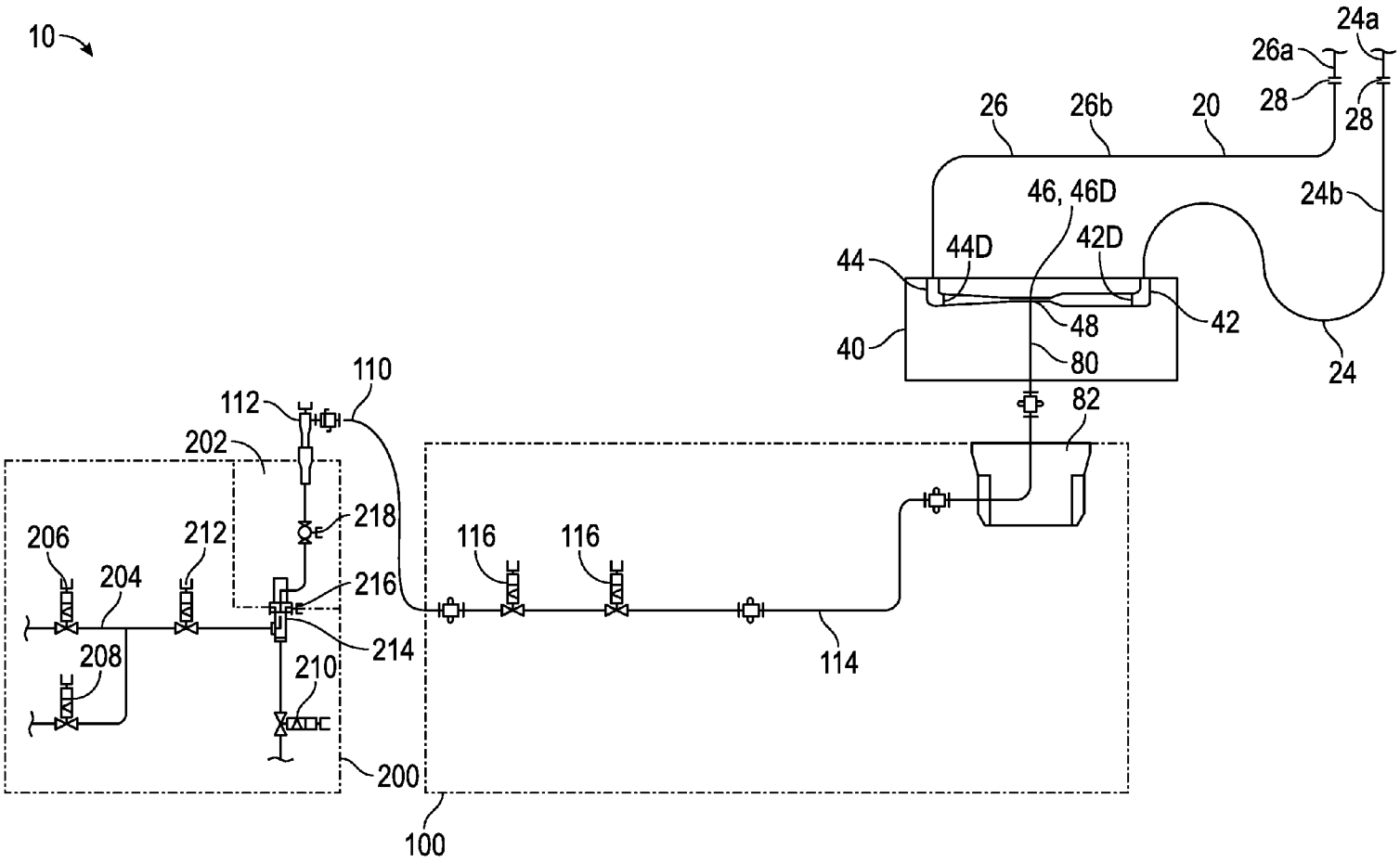
FIG. 2 is a schematic block diagram of the fluid system shown in FIG. 1.

Referring to FIGS. 1 and 2, pressure modulator 40 of fluid system 10 is generally configured to alter or modulate a hydraulic pressure of a fluid disposed in fluid flow loop 22. In certain embodiments, pressure modulator 40 is configured to create a region of sub-hydrostatic pressure (i.e., a low pressure or vacuum region) within flow loop 22, which may be selectively communicated to hydrate skid 100 and subsea equipment 200. In the embodiment shown in FIG. 2, pressure modulator 40 comprises a fluid eductor or injector including a fluid inlet 42, a fluid outlet 44, a reduced diameter section or constriction 46, and a pressure port 48. Fluid inlet 42 of pressure modulator 40 is in fluid communication with flexible injection conduit 24*b* while the fluid outlet 44 is in fluid communication with flexible return conduit 26*b*. Additionally, pressure port 48 is in fluid communication with pressure conduit 80. In this configuration, pressure modulator 40 is configured to provide a pressure differential between fluid inlet 42 and pressure port 48 while not including any moving parts, which may be prone to failure in subsea environments.

Although pressure modulator 40 is shown in FIG. 2 as comprising an eductor, in other embodiments, pressure modulator 40 may comprise other devices for creating a low pressure region, such as a venturi, orifice plate, etc. In this embodiment, reduced diameter section 46 of pressure modulator 40 includes an inner diameter 46D that is less than an inner diameter 42D of inlet 42 and an inner diameter 44D of outlet 44, thereby forming a constriction or reduced flow area in pressure modulator 40. Due to the venturi effect, the flow constriction formed by reduced diameter section 46 of pressure modulator 40 increases the flow rate of fluid entering reduced diameter section 46 from inlet 42 while, in turn, decreases the fluid pressure of fluid entering reduced diameter section 46. In other words, when fluid is flowing through pressure modulator 40, entering modulator 40 from inlet 42 and exiting through outlet 44, fluid passing through reduced diameter section 46 is at a higher flow rate but a lower fluid pressure than fluid passing through either inlet 42 or outlet 44.

As shown particularly in FIG. 2, in this embodiment hydrate skid 100 additionally includes one or more fluid hydrate conduits 114 and a pair of hydrate valves 116 for selectively establishing fluid communication between pressure conduit 80 and jumper 110 via hydrate conduits 114. In this embodiment, hydrate valves 116 are configured to be operable in-situ subsea by a ROV, such as ROV 14 shown in FIG. 1; however, in other embodiments, hydrate valves 116 may comprise remotely operated valves actuated in response to the communication of a signal from a controller or control system. Also as shown particularly in FIG. 2, in this embodiment subsea tree 200 additionally includes a plurality of fluid conduits, valves, and other devices. For example, subsea tree 200 includes fluid tree conduits 204, a production master valve 206, a cross-over valve 208, a flowline isolation valve 210, a production wing valve 212, a pressure control valve 214, a non-return valve 216, and a manual master valve 218. Non-return valve 216 and pressure control valve 214 provide access to the fluid components of subsea tree 200 from injection insert 202 while the remaining fluid components provide access to fluid components of either subsea tree 200 or other associated production equipment in fluid communication with subsea tree 200, such as production pipelines, wells, manifolds, and other devices. In certain embodiments, subsea tree 200 may include additional components not shown in FIG. 2. Additionally, in other embodiments, subsea tree 200 may not include each of the components shown in FIG. 2.

Still referring to FIGS. 1 and 2, during normal operation subsea tree 200 receives hydrocarbons from a well extending into a subterranean formation extending beneath the sea floor 5 and distributes the received hydrocarbons to other components of fluid system 10, such as production pipelines, risers, manifolds, and the like. In certain embodiments, during normal operation subsea tree 200 may include a production choke in lieu of the injection insert 202 shown in FIGS. 1 and 2. During operation of subsea tree 200, hydrates may form within subsea tree 200, such as in tree conduits 204, or in other associated production equipment in fluid communication with subsea tree 200 (e.g., production pipelines, risers, manifolds, etc.), creating a blockage to fluid flow therethrough.

In the event of the formation of hydrates in subsea tree 200 (or components in fluid communication with subsea tree 200), hydrate skid 100 is deployed or lowered from surface vessel 12 to the sea floor 5 at a position proximal subsea tree 200. In certain embodiments, a production choke coupled to subsea tree 200 may be removed therefrom and replaced with injection insert 202 to allow for fluid connectivity between subsea tree 200 and hydrate skid 100. Additionally, injection fluid conduit 24, return fluid conduit 26, pressure modulator 40, and pressure conduit 80 are deployed subsea from surface vessel 12 such that pressure conduit 80 is positioned within the vicinity of hydrate skid 100. Following deployment of conduits 24, 26, 80, and pressure modulator 40, hydrate removal system 20 are placed in fluid communication with hydrate skid 100 by connecting pressure conduit 80 to hydrate skid 100 via hydrate connection 82. In some embodiments, hydrate connection 82 is made up by operating ROV 14. In certain embodiments, hydrate removal system 20 may be directly connected to subsea tree 200, obviating the deployment of hydrate skid 100.

With hydrate removal system 20 connected to hydrate skid 100, hydrate skid 100 is connected to subsea tree 200 by connecting jumper 110 to the injection insert assembly 202 of subsea tree 200 via equipment connection 112. In some embodiments, equipment connection 112 is made up by operating ROV 14. In this embodiment, hydrate skid 100 is deployed with hydrate valves 116 disposed in the closed position, thereby restricting fluid communication between the tree conduits 204 of subsea tree 200 and hydrate conduit 114 of hydrate skid 100 even after jumper 110 is connected to subsea tree 200 via equipment connection 112. Thus, following the making up of equipment connection 112, hydrate valves 116 are actuated into an open position establishing fluid communication between both hydrate removal system 20 and hydrate conduit 114 with tree conduits 204 of subsea tree 200.

In this embodiment, once hydrate removal system 20 is placed in fluid communication with subsea tree 200 (e.g., tree conduits 204) and other associated production equipment in fluid communication with subsea tree 200 (e.g., subsea pipelines, risers, manifolds, etc.), pump 30 at surface vessel 12 is actuated to establish a continuous flow of hydrate removal fluid through fluid loop 22. In certain embodiments, pump 30 may be actuated prior to the actuation of hydrate valves 116 into the open position. In this embodiment, the hydrate removal fluid pumped through fluid loop 22 comprises a hydrate inhibitor fluid such as methanol, mono-ethylene glycol, and the like; however, the hydrate removal fluid may comprise any pumpable fluid, such as water. As the hydrate removal fluid flows from pump 30, through injection conduit 24, pressure modulator 40, and return conduit 26 in a continuous fluid loop, a sub-hydrostatic or vacuum fluid pressure region is created within reduced diameter section 46 of pressure modulator 40. The vacuum pressure within reduced diameter section 46 is communicated to subsea tree 200 via hydrate conduit 114 of hydrate skid 100 and jumper 110, thereby placing at least a portion of at least some of the fluid components of subsea tree 200 (as well as possibly other fluid components in fluid communication with subsea tree 200), such as tree conduits 204, under a vacuum or sub-hydrostatic fluid pressure. In some embodiments, the vacuum pressure comprises a fluid pressure that is less than the hydrostatic pressure of fluid disposed in subsea tree 200 and/or associated production equipment.

The hydrate blockage formed in either subsea tree 200 or hydrocarbon production associated therewith acts as a barrier to restrict further communication of the vacuum pressure provided by pressure modulator 40. In this arrangement, one side of the hydrate blockage receives or is exposed to the vacuum pressure provided by pressure modulator 40. In some instances, the vacuum pressure communicated to the hydrate blockage is sufficient to melt or eliminate the hydrate blockage, thereby causing pressure modulator 40 (and jumper 110 and hydrate conduit 114 of hydrate skid 100) to receive full hydrostatic pressure from subsea tree 200 and its associated production equipment, which had previously been isolated from pressure modulator 40 by the blockage formed by the solid hydrates.

Therefore, following the elimination of the hydrate blockage formed in either subsea tree 200 or its associated production equipment, fluid pressure is increased within the reduced diameter section 46 of pressure modulator 40 due to the communication of full hydrostatic pressure from subsea tree 200 thereto, which is in turn communicated to surface vessel 12 as fluid flows continuously through fluid loop 22. Thus, by monitoring fluid pressure within fluid loop 22 and hydrate removal system 20 via a pressure indicator (not shown), such as at the upper end of the return conduit 26 at surface vessel 12, personnel of surface vessel 12 may monitor and identify the successful elimination of a hydrate blockage in subsea tree 200 or its associated production equipment indicated by an increase in fluid pressure within hydrate conduits 114 of hydrate skid 100. Thus, signal communication may be provided between hydrate skid 100 and surface vessel 12 to provide real-time or near real-time indication of fluid pressure within hydrate conduits 114 of hydrate skid 100 at surface vessel 12. In some embodiments, signal communication between hydrate skid 100 and surface vessel 12 may be provided wirelessly via a wireless transmitter located at hydrate skid 100 and a wireless receiver located at surface vessel 12. In other embodiments, a hard-wired connection may be provided between hydrate skid 100 and surface vessel 12. Once the hydrate blockage is eliminated, hydrocarbons from subsea tree 200 and/or its associated production equipment may enter flow loop 22 and be communicated to the surface vessel 12. In such an event, hydrocarbons communicated from subsea are stored in tank 36 to prevent them from being exposed to the surrounding environment.

Once the elimination of the hydrate blockage is identified at surface vessel 12 (or subsea via monitoring of a subsea pressure indicator using ROV 14), hydrate valves 116 are actuated into the closed position and both equipment connection 112 and hydrate connection 82 are disconnected, allowing for the retrieval of hydrate skid 100 and hydrate removal system 20 to surface vessel 12. In some embodiments, injection insert assembly 202 may be removed from subsea tree 200 and replaced with a production choke to allow subsea tree 200 and its associated production equipment to return to normal operation.

In some instances, the application of vacuum pressure to the hydrate blockage formed in either subsea tree 200 or its associated production equipment may be insufficient to melt or eliminate the hydrate blockage formed therein. Thus, in certain embodiments, cycles of alternating vacuum and positive pressures are applied to the hydrate blockage until the blockage is removed or eliminated, the application of positive pressure acting to release or displace the hydrate blockage. Additionally, the application of positive fluid pressure to subsea tree 200 and its associate production components allows for the communication of hydrate inhibiting fluid, when hydrate inhibiting fluid is used as the hydrate removal fluid of hydrate removal system 20, to subsea tree 200 and associate components, with the hydrate inhibiting fluid acting to eliminate or mitigate solid hydrates formed therein. For example, in an embodiment, following the application of vacuum pressure to subsea tree 200 and its associated production equipment as hydrate removal fluid flows through fluid loop 22 at a continuous or substantially constant rate, fluid loop valve 34 is closed at the surface vessel 12 while pump 30 continues in operation, thereby increasing fluid pressure within fluid loop 22, pressure modulator 40, hydrate skid 100, and jumper 110, and communicating increased fluid pressure to the hydrate blockage formed in subsea tree 200 and/or its associated production equipment.

In some embodiments, pump 30 is actuated until the positive or elevated fluid pressure communicated to the hydrate blockage formed in subsea tree 200 and/or its associated production equipment is at the maximum design pressure of that equipment. In this manner, a pressure differential is applied to the hydrate blockage, with the positive fluid pressure communicated to the side of the blockage in fluid communication with hydrate removal system 20 being at a greater pressure than hydrostatic pressure of subsea tree 200 applied to the opposing side of the hydrate blockage. The application of a pressure differential across the hydrate blockage acts to dislodge the hydrate blockage, thereby allowing for the establishment of fluid communication between the hydrostatic pressure of subsea tree 200 and the positive pressure applied to subsea tree 200 from hydrate removal system 20.

As with the elimination of a hydrate blockage in response to the application of a negative or vacuum pressure described above, the dislodging of the hydrate blockage may be monitored and indicated by a change in fluid pressure indicated in flow loop 22. In some embodiments, cycles of negative and positive pressure (i.e., cycles of sub-hydrostatic pressure and pressure in excess of hydrostatic pressure) are applied to the hydrate blockage formed in subsea tree 200 and/or its associated production equipment until the hydrate blockage is removed or eliminated.

Figure 3:
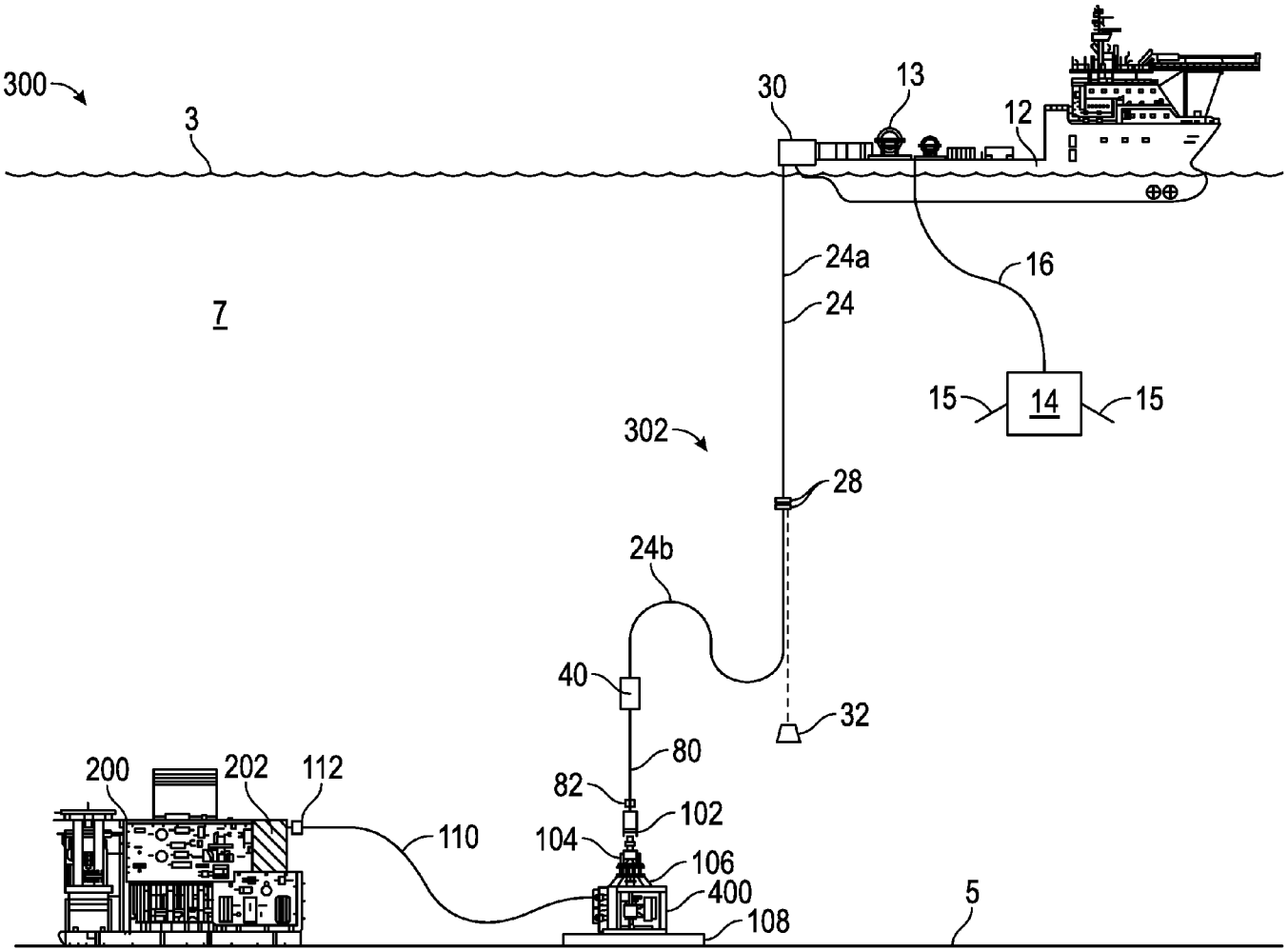
FIG. 3 is a schematic view of an embodiment of a fluid system in accordance with principles disclosed herein.

Referring to FIG. 3, another embodiment of a fluid system 300 is shown schematically. Fluid system 300 includes components and features in common with fluid system 10 described above, and shared features are labeled similarly. In the embodiment shown in FIG. 3, fluid system 300 comprises a hydrate removal system 302 only includes injection fluid conduit 24, and does not include return fluid conduit 26. Thus, while hydrate removal system 20 of fluid system 10 comprises a dual conduit fluid system (i.e., includes both injection and return conduits 24 and 26), hydrate removal system 302 of fluid system 300 comprises a single conduit fluid system including only injection conduit 24. Additionally, in lieu of hydrate skid assembly 100 of fluid system 10, in this embodiment fluid system 300 includes hydrate skid assembly 400. Hydrate skid 400 of fluid system 300 includes features in common with hydrate skid 100 of fluid system 10, and shared features are labeled similarly.

Figure 4:
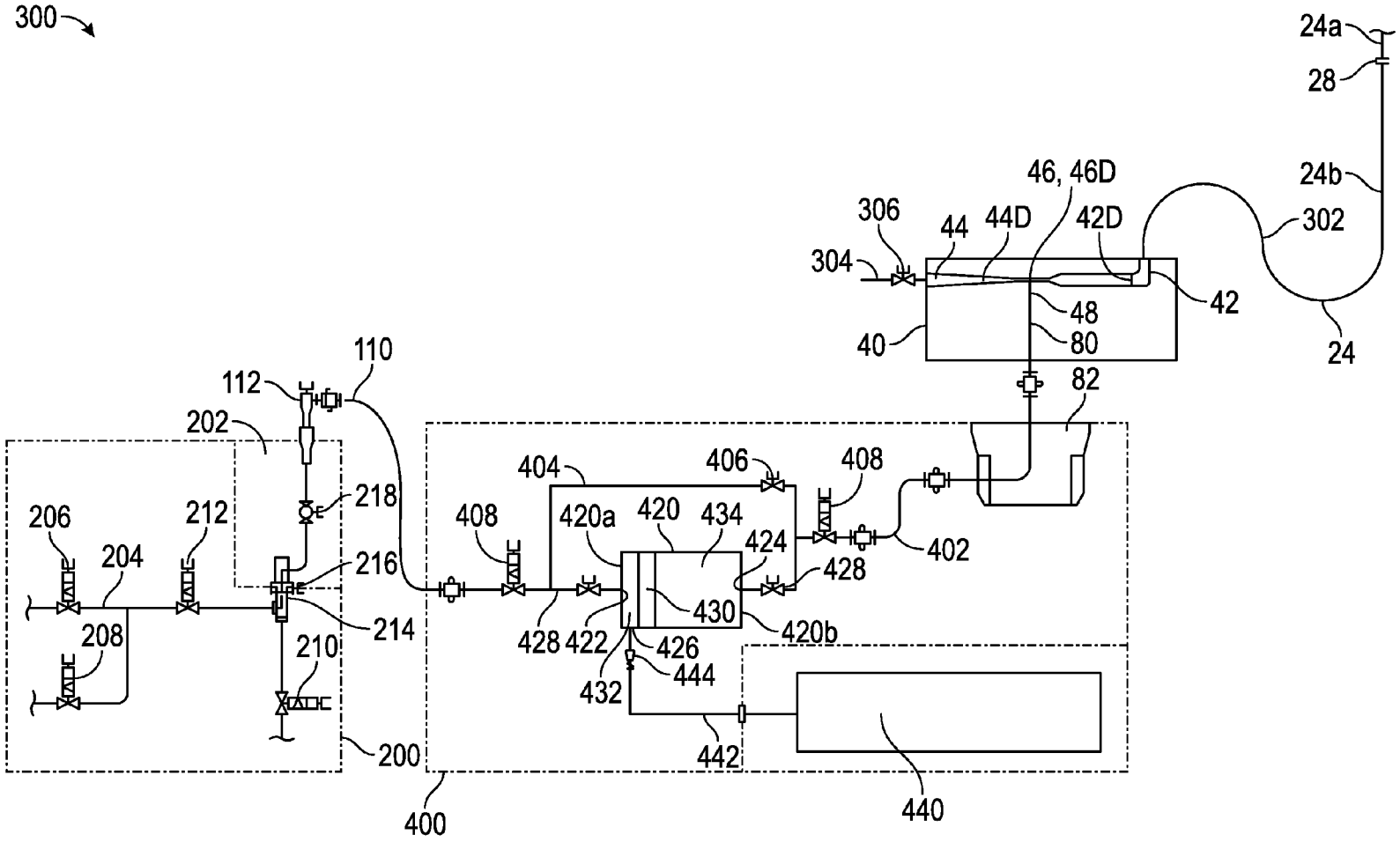
FIG. 4 is a schematic block diagram of the fluid system shown in FIG. 3.
Figure 5:
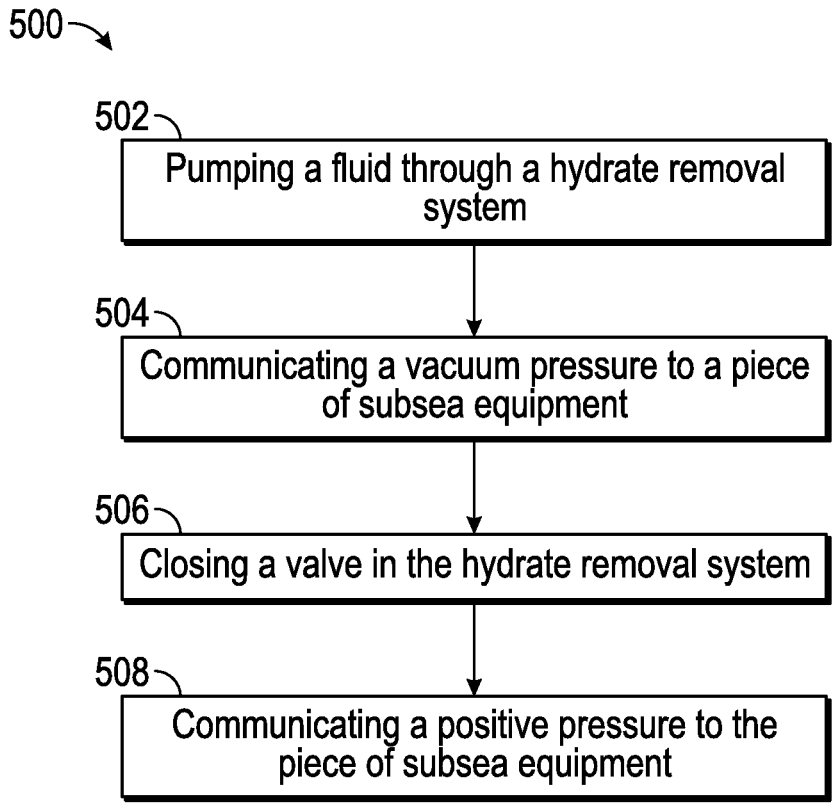
FIG. 5 is a block diagram of an embodiment of a method for treating the formation of hydrates in a fluid system in accordance with principles disclosed herein.

Referring to FIGS. 3 and 4, in this embodiment the fluid outlet 44 (shown in FIG. 4) of pressure modulator 40 is connected to and in fluid communication with a vent line 304 including a vent valve 306 configured to provide selective fluid communication between outlet 44 of pressure modulator 40 and the sea 7 (shown in FIG. 3). In this embodiment, vent valve 306 comprises an ROV operated valve; however, in other embodiments, vent valve 306 may comprise a remotely actuatable valve or a manually operated valve. In the arrangement shown in FIG. 4, when vent valve 306 is actuated into the closed position, fluid communication between hydrate removal system 302 and the sea 7 is restricted; and when vent valve 306 is actuated into the open position, fluid communication between hydrate removal system 302 and the sea 7 is permitted.

In the embodiment shown in FIG. 4, hydrate skid 400 comprises a first or main fluid conduit 402 and a second or bypass fluid conduit 404 disposed in parallel with main conduit 402, where bypass fluid conduit 404 includes a bypass valve 406 for selectively restricting fluid communication therethrough. In addition, main conduit 402 includes a pair of hydrate valves 408 flanking (i.e., disposed downstream and upstream) bypass conduit 404. In this embodiment, hydrate skid 400 includes a hydraulic cylinder 420 connected to and in fluid communication with main conduit 402, where hydraulic cylinder 420 includes a first end **420*a*, a second end 420*b* longitudinally or axially spaced from first end 420*a*, a first fluid port 422 at first end 420*a*, a second fluid port 424 at second end 420*b*, and a third port 426 disposed between ends 420*a* and 420*b*. A floating piston 430 is slidably disposed within cylinder 420 and sealingly engages an inner surface of cylinder 420 to form a first chamber 432 extending between the first end 420*a* of cylinder 420 and a first piston face of piston 430, and a second chamber 434 extending between second end 420*b* and a second piston face of piston 430. An isolation valve 428 is disposed adjacent each end 420*a* and 420*b* of cylinder 420 to allow cylinder 420 to be isolated from bypass conduit 404 when fluid flow through bypass conduit 404** is desired.

In the configuration described above and shown in FIG. 4, fluid communication between first chamber 432 and second chamber 434 is restricted via the sealing engagement between piston 430 and the inner surface of cylinder 420. Therefore, first chamber 432 is in selective fluid communication with jumper 110 while second chamber 434 is in selective fluid communication with pressure conduit 80. In this embodiment, hydrate skid 400 further includes a storage tank 440 in fluid communication with first chamber 432 of cylinder 420 via a tank conduit 442 connected with third port 426 of cylinder 420. Tank conduit 442 includes a check valve 444 that restricts fluid flow from tank 440 into first chamber 432. As will be discussed further herein, tank 440 is configured to receive and store hydrocarbons from subsea tree 200 and/or associated production equipment in communication with tree 200 following the removal of hydrates formed therein.

Still referring to FIGS. 3 and 4, hydrate removal system 302 and hydrate skid 400 are configured to eliminate or remove hydrate blockages formed in subsea tree 200 and/or associated production equipment. In this embodiment, hydrate skid 400 is deployed to the sea floor 5 and hydrate removal system 302 is deployed subsea to a position within the vicinity of hydrate skid 400 from surface vessel 12. Following positioning of hydrate removal system 302 and hydrate skid 400, hydrate removal system 302 is placed into fluid communication with hydrate skid 400 by connecting pressure conduit 80 to hydrate skid 400 via hydrate connection 82. Additionally, hydrate skid 400 is connected to subsea tree 200 by connecting jumper 110 to the injection insert assembly 202 of subsea tree 200 via equipment connection 112. In this embodiment, hydrate skid 400 is deployed from surface vessel 12 with hydrate valves 408 disposed in the closed position, isolation valves 428 disposed in the open position, and bypass valve 406 disposed in the closed position. Additionally, vent valve 306 of hydrate removal system 302 is disposed in the open position.

With hydrate skid 400 connected to subsea tree 200 via jumper 110, hydrate valves 408 are opened using ROV 14 to place main conduit 402 of hydrate skid 400 into fluid communication with at least some of the fluid components (e.g., tree conduits 204, etc.) of subsea tree 200, and in some instances, production equipment associated with subsea tree 200. In addition, pump 30 at surface vessel 12 is activated to begin pumping hydrate removal fluid at a constant or substantially constant flow rate, with the hydrate removal fluid comprising water, or other pumpable fluids safe for the surrounding environment, into injection conduit 24. The hydrate removal fluid flows into pressure modulator 40 from inlet 42, flows through reduced diameter section 46, and is vented to the sea 7 through outlet 44 and vent line 304. As discussed above, the flow of hydrate removal fluid through reduced diameter section 46 of pressure modulator 40 creates a negative or vacuum pressure in reduced diameter section 46, which is communicated to second chamber 434 of cylinder 420 via main conduit 402 of hydrate skid 400 and pressure conduit 80.

The communication of vacuum pressure to second chamber 434 of cylinder 420 is communicated to first chamber 432 via floating piston 420. In some embodiments, the communication of vacuum pressure to second chamber 434 of cylinder 420 causes piston 430 to be displaced towards second end 420*b* of cylinder 420, thereby communicating the vacuum pressure created by pressure modulator 40 to the first chamber 432 of cylinder 420, which increases in volume in response to the displacement of piston 430 in cylinder 420. In turn, vacuum pressure from first chamber 432 is communicated to the hydrate blockage formed in subsea tree 200 (e.g., tree conduits 204, etc.) and/or associated production equipment via jumper 110. In this arrangement, one side of the hydrate blockage receives or is exposed to the vacuum pressure provided by pressure modulator 40. In some instances, the vacuum pressure communicated to the hydrate blockage is sufficient to melt or eliminate the hydrate blockage, thereby causing first chamber 432 of cylinder 420) to receive full hydrostatic pressure from subsea tree 200 and its associated production equipment, which had previously been isolated from first chamber 432 of cylinder 420 by the blockage formed by the solid hydrates. The hydrostatic pressure communicated to first chamber 432 of cylinder 420 is transmitted to hydrate removal system 302 via floating piston 430 within cylinder 420.

Following the elimination of the hydrate blockage in subsea tree 200 and/or its associated production equipment, by monitoring fluid pressure within hydrate removal system 302 via a pressure indicator (not shown), such as at the upper end of the injection conduit 24 at surface vessel 12, personnel of surface vessel 12 may monitor and identify the successful elimination of a hydrate blockage indicated by an increase in fluid pressure within hydrate removal system 302. Additionally, once the hydrate blockage is eliminated, hydrocarbons from subsea tree 200 and/or its associated production equipment may enter first chamber 432 of cylinder 420 via jumper 110, where hydrocarbons entering first chamber 432 may be received and stored in tank 440 via tank conduit 442. Check valve 444 of hydrate skid 400 prevents hydrocarbons that have entered tank 440 from returning to first chamber 432 of cylinder 420. Once the elimination of the hydrate blockage is identified at surface vessel 12 (or subsea via monitoring of a subsea pressure indicator using ROV 14), hydrate valves 408 are actuated into the closed position and both equipment connection 112 and hydrate connection 82 are disconnected, allowing for the retrieval of hydrate skid 400 and hydrate removal system 302 to surface vessel 12.

In some instances, the application of vacuum pressure to the hydrate blockage formed in either subsea tree 200 or its associated production equipment may be insufficient to melt or eliminate the hydrate blockage formed therein. Thus, in certain embodiments, cycles of alternating vacuum and positive pressures are applied to the hydrate blockage via hydrate removal system 302 until the blockage is removed or eliminated, the application of positive pressure acting to release or displace the hydrate blockage. For example, in an embodiment, following the application of vacuum pressure to subsea tree 200 and its associated production equipment as hydrate removal fluid flows through injection conduit 24 and pressure modulator 40 at a continuous or constant rate, vent valve 306 of vent line 304 is closed by ROV 14 while pump 30 continues in operation, thereby increasing fluid pressure within hydrate removal system 302 until a positive fluid pressure is formed therein. The positive fluid pressure is communicated to the hydrate blockage formed in subsea tree 200 and/or its associated production equipment via piston 430 within cylinder 420 and jumper 110. In some embodiments, positive fluid pressure may be communicated to the hydrate blockage by closing isolation valves 428 and opening bypass valve 406. In some embodiments, pump 30 is actuated until the positive or elevated fluid pressure communicated to the hydrate blockage formed in subsea tree 200 and/or its associated production equipment is at the maximum design pressure of that equipment. In some embodiments, cycles of negative and positive pressure (i.e., cycles of sub-hydrostatic pressure and pressure in excess of hydrostatic pressure) are applied to the hydrate blockage formed in subsea tree 200 and/or its associated production equipment until the hydrate blockage is removed or eliminated by periodically cycling vent valve 306, isolation valves 428, and bypass valve 406 while maintaining operation of pump 30.

Having described fluid systems (e.g., fluid system 10 and fluid system 300) configured for the treatment and/or removal of hydrates within subsea equipment, an embodiment of a method 500 for treating the formation of hydrates in a fluid system is now described. Starting at block 502 of method 500, a fluid is pumped through a hydrate removal system. In some embodiments, the fluid is pumped at a substantially constant fluid flow rate through the hydrate removal system, where the hydrate removal system comprises a pressure modulator. In certain embodiments, block 502 comprises pumping fluid through hydrate removal system 20 of fluid system 10 (shown in FIGS. 1 and 2) via pump 30, including injection conduit 24, pressure modulator 40, and return conduit 26. In other embodiments, block 502 comprises pumping fluid through hydrate removal system 302 of fluid system 300 (shown in FIGS. 3 and 4) via pump 30. In some embodiments, fluid is vented to the surrounding environment via vent line 304 (shown in FIG. 4). In some embodiments, the fluid pumped through the hydrate removal system comprises water; however, in other embodiments, the fluid may comprise a hydrate inhibitor or any other pumpable fluid. In certain embodiments, the fluid flow rate of the pumped fluid is increased as it flows through the reduced diameter section 46 of pressure modulator 40.

At block 504 of method 500, a vacuum pressure is communicated to a piece of subsea equipment. In some embodiments, the vacuum pressure is communicated to a piece of subsea equipment from a pressure port of the pressure modulator. In certain embodiments, the vacuum pressure comprises a fluid pressure that is less than a hydrostatic pressure of fluid disposed in the piece of subsea equipment. In some embodiments, block 504 comprises communicating a vacuum pressure from pressure port 48 of pressure modulator 40, which is in fluid communication with reduced diameter section 46 of pressure modulator 40. In certain embodiments, block 504 comprises communicating the vacuum pressure to the piece of subsea equipment comprises communicating the vacuum pressure to subsea tree 200 via either hydrate skid 100 (shown in FIGS. 1 and 2) or hydrate skid 400 (shown in FIGS. 3 and 4). In other embodiments, the vacuum pressure may be communicated to subsea tree 200 directly from pressure modulator 40 without the use of a separate hydrate skid. In some embodiments, block 504 comprises communicating the vacuum pressure to subsea tree 200 via displacing piston 430 (shown in FIG. 4) within cylinder 420 towards the second end 420*b* of cylinder 420, thereby expanding the volume of first chamber 432 disposed in cylinder 420.

At block 506 of method 500, a valve in the hydrate removal system is closed. In some embodiments, closing the valve in the hydrate removal system ceases the fluid flow through the hydrate removal system at the substantially constant fluid flow rate. In some embodiments, block 506 comprises closing fluid loop valve 34 (shown in FIG. 1) to cease continuous circulation of fluid through injection conduit 24, pressure modulator 40, return conduit 26, and pump 30. In certain embodiments, block 506 comprises closing vent valve 306 (shown in FIG. 4) of vent line 304 to cease the continuous fluid flow through injection conduit 24 and pressure modulator 40. In some embodiments, vent valve 306 is actuated between open and closed positions via ROV 14 (shown in FIG. 3); however, in other embodiments, vent valve 306 may be electronically actuated via a controller. At block 508 of method 500, a positive pressure is communicated to the piece of subsea equipment. In some embodiments, the positive pressure comprises a pressure greater than the vacuum pressure and the positive pressure is communicated to the piece of subsea equipment in response to closing the valve of the hydrate removal system. In certain embodiments, the positive pressure comprises the maximum design pressure of the piece of subsea equipment, such as the maximum design pressure of subsea tree 200 and/or its associated production components.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A fluid system, comprising:

an injection conduit extending between a pump and an inlet of a pressure modulator;

a return conduit extending between the pump and an outlet of the pressure modulator; and a pressure conduit extending from a pressure port of the pressure modulator, and wherein the pressure conduit is in selective fluid communication with a piece of subsea equipment;

wherein the pump is configured to provide a continuous fluid flow through a fluid loop comprising the injection conduit, pressure modulator, and return conduit;

wherein the pressure modulator comprises a reduced diameter section disposed between the inlet and the outlet, and wherein the pressure port is in fluid communication with the reduced diameter section;

wherein, in response to the provision of continuous fluid flow through the pressure modulator by the pump, a vacuum pressure is communicated to the piece of subsea equipment from the reduced diameter section of the pressure modulator to remove a hydrate blockage formed in the piece of subsea equipment;

wherein the fluid loop is configured to selectively prohibit continuous fluid flow through the fluid loop to communicate a positive pressure greater than the vacuum pressure to the piece of subsea equipment.

2. The fluid system of claim 1, wherein the pump is disposed on a surface vessel and the injection conduit and return conduit each extend from the surface vessel towards a sea floor.

3. The fluid system of claim 1, further comprising:

a hydrate skid disposed subsea and spaced from the piece of subsea equipment, wherein the pressure conduit is connected to the hydrate skid; and a jumper conduit extending between the hydrate skid and the piece of subsea equipment;

wherein the hydrate skid comprises a hydrate skid valve configured to provide selective fluid communication between the pressure conduit and the jumper conduit.

4. The fluid system of claim 1, wherein the fluid loop comprises a hydrate removal valve configured to selectively prohibit continuous fluid flow through the fluid loop.

5. The fluid system of claim 4, wherein, in response to closure of the hydrate removal valve, the pump is configured to increase pressure in the fluid loop to the positive pressure.

6. The fluid system of claim 5, wherein the positive pressure comprises the maximum design pressure of the piece of subsea equipment.

7. The fluid system of claim 4, wherein the hydrate removal valve is located at a surface vessel.

8. The fluid system of claim 4, wherein the hydrate removal valve is connected between the outlet of the pressure modulator and the pump.

9. A fluid system, comprising:

an injection conduit extending between a pump and an inlet of a pressure modulator;

a hydrate skid comprising a piston slidably disposed within a cylinder, and wherein an outer surface of the piston sealingly engages an inner surface of the cylinder to form a first chamber extending between a first end of the cylinder and the piston and a second chamber extending between a second end of the cylinder and the piston;

a pressure conduit extending from a pressure port of the pressure modulator and in selective fluid communication with the second chamber of the cylinder; and a jumper conduit in selective fluid communication with the first chamber of the cylinder and a piece of subsea equipment;

wherein the pump is configured to provide a continuous fluid flow through the injection conduit and pressure modulator;

wherein, in response to the provision of continuous fluid flow through the pressure modulator by the pump, a vacuum pressure is communicated to the piece of subsea equipment from the pressure port of the pressure modulator to remove a hydrate blockage formed in the piece of subsea equipment.

10. The fluid system of claim 9, wherein the pump is disposed on a surface vessel and the injection conduit extends from the surface vessel towards a sea floor.

11. The fluid system of claim 9, wherein:

in response to the provision of continuous fluid flow through the pressure modulator by the pump, the vacuum pressure is communicated to the second chamber of the cylinder; and in response to communication of the vacuum pressure to the second chamber of the cylinder, the piston is configured to be displaced through the cylinder to communicate the vacuum pressure to the first chamber of the cylinder.

12. The fluid system of claim 11, wherein the hydrate skid comprises a storage tank in fluid communication with the first chamber of the cylinder, and wherein the storage tank is configured to store hydrocarbons received from the piece of subsea equipment in response to the removal of the hydrate blockage.

13. The fluid system of claim 9, wherein the pressure modulator comprises a reduced diameter section disposed between the inlet and an outlet, and wherein the pressure port is in fluid communication with the reduced diameter section.

14. The fluid system of claim 13, further comprising a vent line extending from the outlet of the pressure modulator and in fluid communication with the surrounding environment, wherein the vent line comprises a vent valve configured to provide selective fluid communication between the outlet of the pressure modulator and the surrounding environment.

15. The fluid system of claim 14, wherein, in response to closure of the vent valve, the pump is configured to communicate a positive pressure greater than the vacuum pressure to the piece of subsea equipment.

16. A method for treating the formation of hydrates in a fluid system, comprising:

pumping a fluid at a substantially constant fluid flow rate through a hydrate removal system comprising a pressure modulator;

communicating a vacuum pressure to a piece of subsea equipment from a pressure port of the pressure modulator;

closing a valve in the hydrate removal system to cease the fluid flow through the hydrate removal system at the substantially constant fluid flow rate;

communicating a positive pressure greater than the vacuum pressure to the piece of subsea equipment in response to closing the valve of the hydrate removal system; and displacing a piston in a first direction through a cylinder in response to pumping fluid at the substantially constant fluid flow rate to communicate the vacuum pressure between a pair of chambers formed in the cylinder.

17. The method of claim 16, further comprising isolating the piston and communicating the positive pressure to the piece of subsea equipment through a conduit bypassing the piston.

18. The method of claim 16, further comprising pumping the fluid at the substantially constant flow rate from a pump through an injection conduit, through the pressure modulator, and from the pressure modulator to the pump via a return conduit.

19. The method of claim 16, further comprising venting the fluid to the surrounding environment via a vent line extending from an outlet of the pressure modulator.

20. The method of claim 16, further comprising increasing the fluid flow rate of the fluid in response to flowing the fluid through a reduced diameter section of the pressure modulator to form the vacuum pressure in the reduced diameter section.

* * * * *